US008983664B2

(12) United States Patent
Rahilly

(10) Patent No.: US 8,983,664 B2
(45) Date of Patent: Mar. 17, 2015

(54) RECEPTACLE WITH DUAL-FUNCTION ACTUATOR

(75) Inventor: Michael Rahilly, Encinitas, CA (US)

(73) Assignee: Carefusion 303, Inc., San Diego, CA (US)

( * ) Notice: Subject to any disclaimer, the term of this patent is extended or adjusted under 35 U.S.C. 154(b) by 346 days.

(21) Appl. No.: 13/482,937

(22) Filed: May 29, 2012

(65) Prior Publication Data

US 2013/0325183 A1 Dec. 5, 2013

(51) Int. Cl.
*E05B 65/46* (2006.01)
*E05B 47/00* (2006.01)

(52) U.S. Cl.
CPC ..... *E05B 47/00* (2013.01); *E05B 65/46* (2013.01)
USPC ..... 700/275; 700/231; 700/242; 700/237; 700/236; 700/243

(58) Field of Classification Search
None
See application file for complete search history.

(56) References Cited

U.S. PATENT DOCUMENTS

| | | | | |
|---|---|---|---|---|
| 6,116,461 | A | 9/2000 | Broadfield et al. | |
| 6,338,007 | B1 | 1/2002 | Broadfield et al. | |
| 6,510,962 | B1 * | 1/2003 | Lim | 221/15 |
| 7,036,852 | B2 * | 5/2006 | Cho | 292/33 |
| 7,040,504 | B2 | 5/2006 | Broadfield et al. | |
| 7,426,425 | B2 * | 9/2008 | Meek et al. | 700/237 |
| 7,630,789 | B2 * | 12/2009 | Broadfield et al. | 700/231 |
| 7,630,791 | B2 * | 12/2009 | Nguyen et al. | 700/242 |
| 7,657,344 | B2 * | 2/2010 | Holmes et al. | 700/242 |
| 7,909,418 | B2 * | 3/2011 | McFarland | 312/215 |
| 8,019,470 | B2 * | 9/2011 | Meek et al. | 700/237 |
| 8,197,017 | B2 * | 6/2012 | Rahilly | 312/222 |
| 8,271,128 | B1 * | 9/2012 | Schultz | 700/236 |
| 8,332,066 | B2 * | 12/2012 | Weber | 700/242 |
| 8,335,588 | B2 * | 12/2012 | Rahilly et al. | 700/242 |
| 8,347,668 | B2 * | 1/2013 | Min | 70/107 |
| 8,457,784 | B2 * | 6/2013 | Rahilly et al. | 700/242 |
| 2004/0256860 | A1 * | 12/2004 | Tsai | 292/51 |
| 2005/0103066 | A1 * | 5/2005 | Botha et al. | 70/107 |
| 2005/0207087 | A1 * | 9/2005 | Fisher et al. | 361/160 |
| 2008/0179898 | A1 * | 7/2008 | Juga et al. | 292/254 |
| 2010/0018264 | A1 * | 1/2010 | Nygren et al. | 70/91 |
| 2011/0309640 | A1 * | 12/2011 | Matsubara | 292/159 |
| 2012/0191241 | A1 * | 7/2012 | Rahilly et al. | 700/231 |
| 2013/0079927 | A1 * | 3/2013 | Rahilly et al. | 700/242 |

* cited by examiner

*Primary Examiner* — Darrin Dunn
*Assistant Examiner* — Christopher E Everett
(74) *Attorney, Agent, or Firm* — McDermott Will & Emery LLP

(57) ABSTRACT

A receptacle adapted for removable placement on a retention tray is disclosed. The receptacle includes a lid having a closed position and a lid hook. The receptacle includes a latching apparatus with a lid latch configured to engage the lid hook when the lid is in the closed position. The latching apparatus also has a tray latch configured to engage a tray hook that is coupled to the retention tray when the receptacle is placed on the retention tray. The latching apparatus has an actuator configured to selectably release either the lid hook or the tray hook, thus eliminating a need for a second set of actuators in the retention tray to releasably secure the receptacles to the tray.

19 Claims, 6 Drawing Sheets

RECEPTACLE WITH DUAL-FUNCTION ACTUATOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field

The present invention generally relates to transportable controlled-access containers.

2. Description of the Related Art

Medications that are expensive or are controlled substances are carefully controlled in hospitals and other healthcare facilities. Many facilities use Automated Dispensing Machines (ADMs) to provide controlled access to such medications without the need for a pharmacist to personally fill every order. The use of a transportable container that is secure during transport is disclosed in U.S. Pat. No. 6,116,461 to Broadfield et al., which is hereby incorporated herein by reference. FIGS. 1A-1E and 2A-2B are adapted from Broadfield.

Broadfield discloses that a receptacle 30 includes a latch member 56 that captures and retains a hook 44 to secure the lid in a "closed" position and that the lid is released by energizing a first muscle wire 54 that moves the latch member 56 thereby releasing the hook 44. Broadfield further teaches that the receptacle 30 is secured within a drawer 114 by a latching engagement member 154 located under a tray 115 in the drawer 114. The receptacle 30 is released from the drawer 114 by energizing a second muscle wire (not visible in FIGS. 2A and 2B) mounted under the tray 115 that moves the latching engagement member 154 thereby releasing the hook 44. As such, each receptacle 30 requires a first muscle wire and each receptacle docking location in drawer 114 requires a second muscle wire.

Currently available drawers of this type are prone to damage of the latching engagement members 154 and associated second muscle wires as these elements are exposed when a receptacle docking location is empty, rendering the elements susceptible to damage from dropped objects. In addition, as the muscle wires are located across the entire area of the drawer, some drawer systems use a single very large printed circuit board assembly (PCBA) that covers the bottom of the drawer to provide all of the muscle wires and associated drive circuits. A PCBA of this size is expensive, which consequently makes replacement of a damaged PCBA expensive.

SUMMARY

It is desirable to be able to secure the lid of a transportable receptacle and secure the receptacle in a drawer, for example in an ADM, without requiring separate actuators for each securing function for each receptacle. It is also desirable to improve the reliability of the system and reduce the cost by reducing the number of actuators and associated circuitry required for each receptacle.

In certain embodiments, a receptacle adapted for removable placement on a retention tray is disclosed. The receptacle includes a body and a lid movably coupled to the body. The lid has a closed position and a lid hook. The receptacle also includes a latching apparatus coupled to the body. The latching apparatus has a lid latch having a latched position. The lid latch is configured to engage the lid hook when the lid is in the closed position and the lid latch is in the latched position. The latching apparatus also has a tray latch having a latched position. The tray latch is configured to engage a tray hook that is coupled to the retention tray when the receptacle is placed on the retention tray. The latching apparatus also has an actuator configured to selectably move in a first direction thereby urging the lid latch to move away from the latched position. The actuator is further configured to selectably move in a second direction that is opposite the first direction thereby urging the tray latch to move away from the latched position.

In certain embodiments, a latch apparatus for securing and selectably releasing either of a first hook and a second hook is disclosed. The apparatus includes a substrate and a first latch rotatably coupled to the substrate. The first latch has a latched position and is configured to engage the first hook when the first latch is in the latched position. The apparatus also includes a second latch rotatably coupled to the substrate. The second latch has a latched position and is configured to engage the second hook when the second latch is in the latched position. The apparatus further includes an actuator configured to selectably move in a first direction thereby urging the first latch to move away from the latched position. The actuator is further configured to selectably move in a second direction that is opposite the first direction thereby urging the second latch to move away from the latched position.

In certain embodiments, a drawer system is disclosed that includes a retention tray comprising a plurality of docking locations. Each docking location has a tray hook coupled to the retention tray. The drawer assembly also includes at least one receptacle having a body and a lid movably coupled to the body. The lid has a closed position and a lid hook. The receptacle also includes a latching apparatus coupled to the body. The latching apparatus has a lid latch having a latched position. The lid latch is configured to engage the lid hook when the lid is in the closed position and the lid latch is in the latched position. The latching apparatus also has a tray latch having a latched position. The tray latch is configured to engage the tray hook when the receptacle is placed on one of the docking locations of the retention tray. The latching apparatus also has an actuator configured to selectably move in a first direction thereby urging the lid latch to move away from the latched position. The actuator is further configured to selectably move in a second direction that is opposite the first direction thereby urging the tray latch to move away from the latched position. The retention tray is configured to receive a plurality of receptacles in the plurality docking stations.

In certain embodiments, an ADM is disclosed that includes at least one drawer system having a retention tray comprising a plurality of docking locations each having a tray hook coupled to the retention tray. The drawer system also has at least one receptacle that includes a body and a lid movably coupled to the body. The lid has a closed position and a lid hook. The receptacle also includes a latching apparatus coupled to the body. The latching apparatus has a lid latch having a latched position. The lid latch is configured to engage the lid hook when the lid is in the closed position and the lid latch is in the latched position. The receptacle also has a tray latch having a latched position. The tray latch is configured to engage the tray hook when the receptacle is placed on one of the docking locations of the retention tray. The receptacle further includes an actuator configured to selectably move in a first direction thereby urging the lid latch to move away from the latched position. The actuator is further configured to selectably move in a second direction that is opposite the first direction thereby urging the tray latch to move away from the latched position.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The following description discloses embodiments of a receptacle adapted for removable placement on a retention tray. In certain embodiments, this tray is located in a drawer of an ADM. In certain embodiments, the retention tray may be an open surface.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

As used within this disclosure, the term "hook" is defined as a retention feature having a capture surface configured for engagement with by a latching element. The retention feature may be configured with an open capture surface such as a ledge or knob or a closed feature such as a pocket or loop. Any feature that can be captured and retained and then selectably released by a second feature falls within the scope of this term.

As used within this disclosure, the term "spring" is defined as any element that creates a resisting force when deformed in a first direction, wherein the resisting force is applied in a second direction opposite to the first direction. Examples of springs include blocks of a compressible elastic material, bands of a stretchable elastic material, plastic cantilevers, and metal coils.

As used within this disclosure, the term "motor" is defined as any device wherein a first part is caused to move with respect to a second part by the application of electricity. As an example, the first part may be a shaft or rotor and the second part may be a housing or stator. Another example is a solenoid where the first part is the moving core and the second part is the stationary coil. The forces between the first and second parts may be created by interaction of one or more of permanent magnets, metallic elements, and electrical circuits. A motor may include electrical components that control the flow of electricity through one or more portions of the motor, including one or more of a switch such as a transistor, a sensing element such as a Hall effect sensor, a control element such as a processor, and a signal handling device such as a transceiver. A motor may include digital electronics to accept commands and provide signals to other electronics.

Figure 1A:
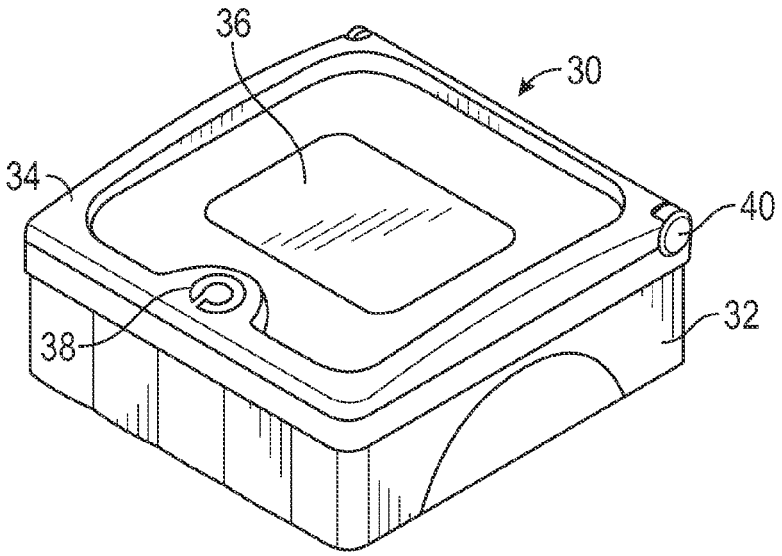
FIG. 1A (Prior Art)
FIGS. 1A-1E are views of a prior art receptacle and latching arrangement disclosed in U.S. Pat. No. 6,116,461.
Figure 1B:
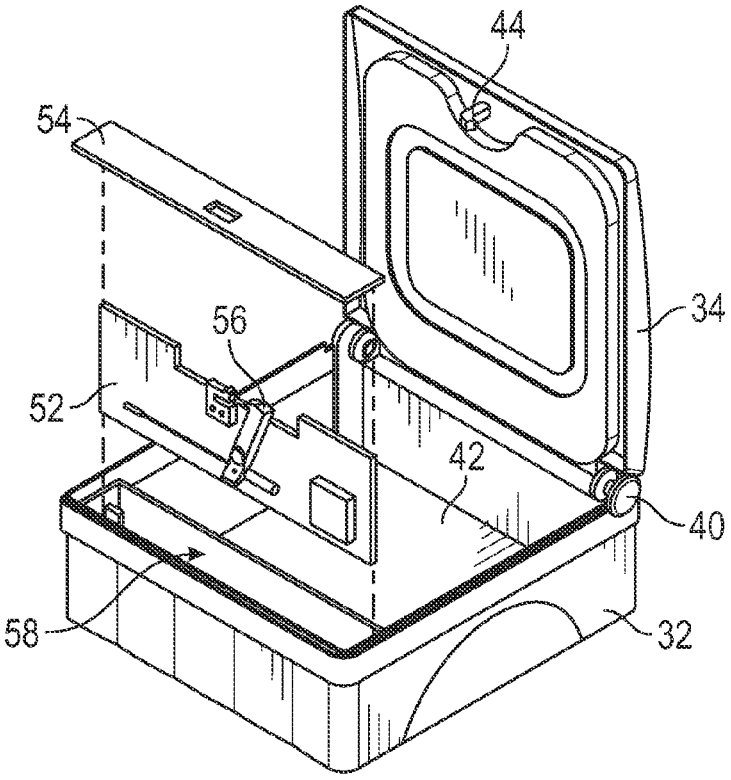
FIG. 1B (Prior Art)
Figure 3:
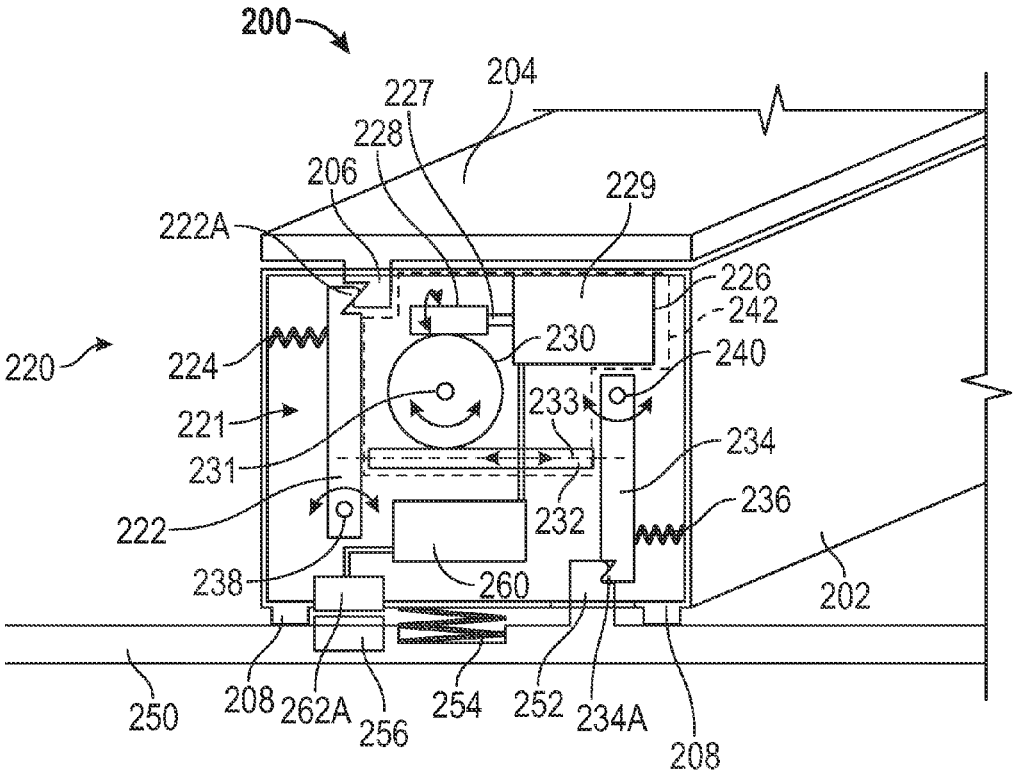
FIG. 3 depicts an exemplary receptacle and latching apparatus according to certain aspects of the present disclosure.

FIGS. 1A and 1B show portions of FIGS. 1 and 3 of U.S. Pat. No. 6,116,461. The receptacle 30 has a plurality of sidewalls 32 that define a storage compartment 42 which is best shown in FIG. 1B. A top 34 can be opened and closed about a hinge 40. A latch assembly 38 is formed between the top 34 and one of the sidewalls 32 to keep the top 34 in a closed position until an authorized operator gains access to the receptacle. The hinge assembly 40 includes a spring 48 and pin 50 which join the receptacle compartment with the top 34. While a hinged top is preferred, a sliding top may be used. The receptacle 30 may further include a compartment 58 for housing a latch assembly 52. The latch assembly 52 may include a latch member 56 and a cover 54.

Figure 1C:
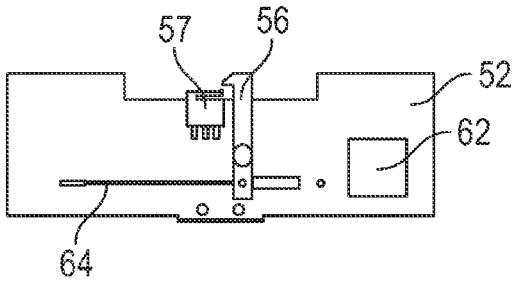
FIG. 1C (Prior Art)
Figure 1D:
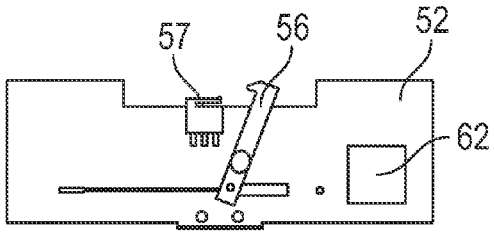
FIG. 1D (Prior Art)
Figure 1E:
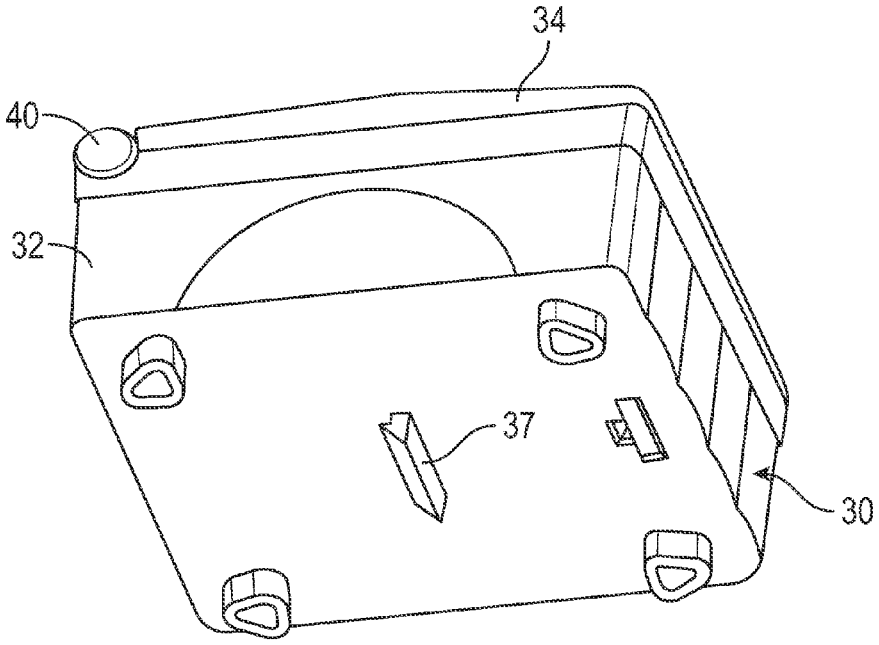
FIG. 1E (Prior Art)
Figure 4:
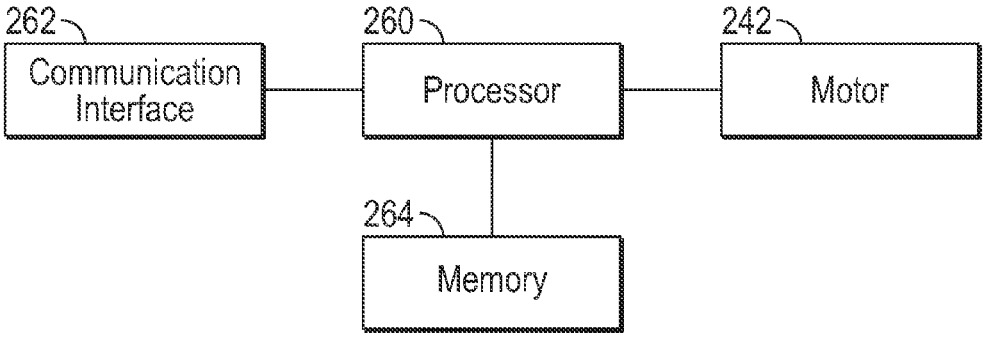
FIG. 4 is a block diagram of an exemplary electronic portion of the receptacle according to certain aspects of the present disclosure.
Figure 5:
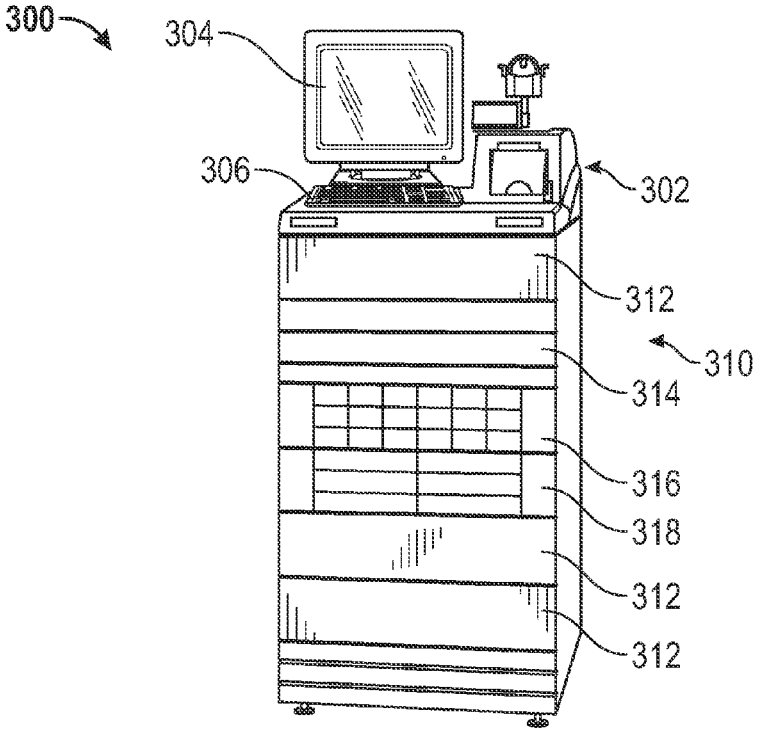
FIG. 5 depicts an exemplary ADM according to certain aspects of the present disclosure.

FIGS. 1C, 1D, and 1E show FIGS. 4, 5, and 8 of U.S. Pat. No. 6,116,461. FIG. 1C shows the latch member 56 in a closed position while FIG. 1D shows the latch member 56 in an open position. A switch 57 may electronically inform an ADM-computer that the top 34 is in an open or closed position. A memory chip 62 may store information concerning the receptacle and its contents. The receptacle 30 itself may be a medication package that contains drugs and a package insert. The receptacle 30 may replace bottles and other types of standard medication packages. An electrical communication contact 66 enables connection from the receptacle to a receiving location within an automated dispensing machine, thus facilitating communication between the receptacle and the computer associated with the automated dispensing machine. When required signals are received at the electrical contact 66, an electronic circuit actuates a muscle wire 64 causing the latch to be actuated and thus opening the top 34. The muscle wire 64 receives a current and upon increasing in temperature the muscle wire 64 pulls to one side by shrinking and thereby causes the latch to be susceptible to a spring force acting upon it from a spring in the hinge assembly 40. It should be noted that the muscle wire 64 is a single-direction actuator, i.e. the muscle wire 64 can pull but cannot push. The spring 48 pushes the top open when the latch is freed. In a preferred embodiment, the lid or top 34 will spring open about 15 degrees when the latch is opened.

Figure 2A:
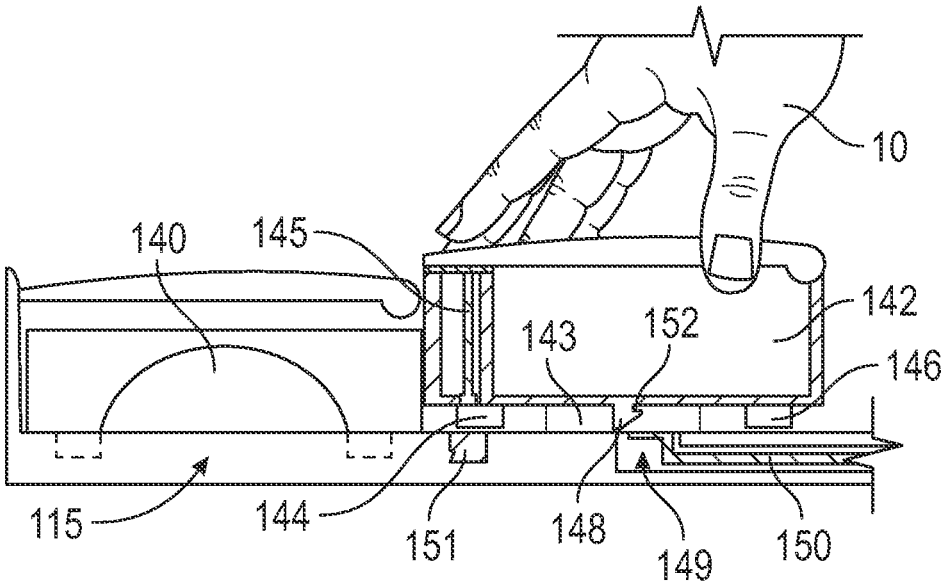
FIG. 2A (Prior Art)
FIGS. 2A and 2B are side views of the prior at latching arrangement of FIGS. 1A-1E.
Figure 2B:
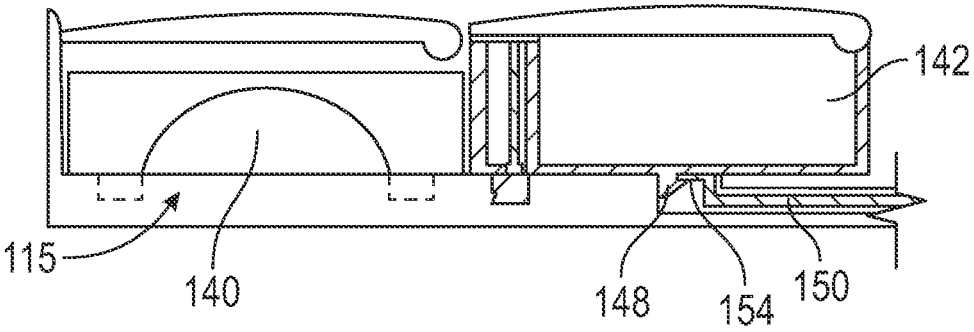
FIG. 2B (Prior Art)

FIGS. 2A and 2B show FIGS. 16 and 17 of U.S. Pat. No. 6,116,461. FIG. 2A shows the insertion of a receptacle 142 into a drawer tray 115 and FIG. 2B shows the same receptacle 142 latched to the drawer tray 115. A nested or adjacent receptacle 140 is also shown already in place. Compression spring 143 is shown in its relaxed state in FIG. 2A and is compressed and not in view in FIG. 2B. Latch member 145 is shown in cross-section view in contact with electrical circuit 151. Latch engagement member 150 is shown in FIG. 2B with end 154 engaged with the retaining hook 152 of engagement member 148 of receptacle 142.

The receptacles that are disclosed herein include a single latch apparatus that replaces the multiple latches of the system disclosed by U.S. Pat. No. 6,116,461. Accomplishing both the lid-latching capability and the receptacle-securing capability with a single actuator that is contained in the removable receptacle offers a significant reduction in cost of the system, compared to the system disclosed by U.S. Pat. No. 6,116,461, and an improvement in the reliability of the overall system while still providing the benefits of the system taught by U.S. Pat. No. 6,116,461. Elimination of the receptacle-securing latches located in the bottom of the drawer assembly disclosed by U.S. Pat. No. 6,116,461 reduces the cost of the drawer assembly disclosed herein and eliminates the risk of the prior design of damage to a receptacle-securing latch when a receptacle is not secured in that location.

FIG. 3 depicts an exemplary receptacle 200 and latching apparatus 220 according to certain aspects of the present disclosure. The receptacle 200 comprises a body 202 having a compartment 221 and a lid 204 that, in certain embodiments, is hingedly attached to the body 202. The cover 221A that is normally coupled to the body 202 to seal the compartment 221 has been moved away from the receptacle 200 to expose the internal components. The lid 204 has a lid hook 206 that protrudes into the compartment 221 when the lid 204 is in the closed position shown in FIG. 3. In certain embodiments, the latching apparatus 220 is disposed within the compartment 221. The latching apparatus comprises a lid latch 222 that is configured to rotate about a pivot 238 that is fixed to the body 202 and engage the lid hook 206. In certain embodiments, a lid latch spring 224 is positioned between the body 202 and the lid latch 222 to urge the lid latch 222 toward the latched position shown in FIG. 3. When the lid latch 222 is engaged with the lid hook 206, the lid 204 cannot be opened without damaging one or more elements of the receptacle 200.

FIG. 3 depicts the receptacle 200 latched to a retention tray 250 having a tray hook 252 that protrudes upward into the compartment 221. The receptacle 200 comprises one or more feet 208 that contact the top of retention tray 250 when the receptacle 200 is placed on the retention tray 250. The latching apparatus 220 further comprises a tray latch 234 that is configured to rotate about a pivot 240 that is fixed to the body 202 and engage the tray hook 252. In certain embodiments, a tray latch spring 236 is positioned between the body 202 and the tray latch 234 to urge the tray latch 234 toward the latched position shown in FIG. 3. A receptacle release spring 254 is disposed between the retention tray 250 and the body 202 of receptacle 200 and configured to urge the receptacle 200 upwards when the tray hook 252 is released.

The latching apparatus 220 also comprises an actuator 242 configured to selectably move in a first direction, for example to the left in the view of FIG. 3, thereby urging the lid latch 222 to move away from its latched position. The actuator 242 is further configured to selectably move in a second direction, for example to the right in the view of FIG. 3, thereby urging the tray latch 234 to move away from its latched position.

In certain embodiments, the actuator 242 comprises a gear rack 232 having an axis 233 and that is movably coupled to the body 202. The gear rack 232 is configured to cause the lid latch 222 to rotate away from the latched position, for example counterclockwise in the view of FIG. 3, when moved in a first direction, for example to the left in the view of FIG. 3. The gear rack 232 is also configured to cause the tray latch 234 to rotate away from the latched position, for example counterclockwise in the view of FIG. 3, when moved in a second direction, for example to the right in the view of FIG. 3.

In certain embodiments, the actuator 242 also comprises a motor 242 comprising a housing 229 that is coupled to the body 202 and a rotatable shaft 227 configured to selectably rotate in a first direction or a second direction opposite the first direction. The shaft 227 is coupled to the gear rack 232 such that rotation of the shaft 227 in the first direction causes the gear rack 232 to move in the first direction and rotation of the shaft 227 in the second direction causes the gear rack 232 to move in the second direction.

In certain embodiments, the latching apparatus 220 includes a processor 260 that is coupled to the motor 226, the processor 260 configured to receive signals from an external device through electrical contacts 262A on an external surface of the body 202. The processor 260 is further configured to cause the motor 226 to rotate in the first direction upon receipt of a lid-release signal and to cause the motor to rotate in the second direction upon receipt of a receptacle-release signal. In certain embodiments, the contacts 262A are configured to removably couple to an electrical connector 256 on the retention tray 250.

An example of accessing the contents of the receptacle 200 begins with the processor 260 receiving a lid-release signal through the electrical contacts 262A. The processor sends a command to the motor 226 to turn in the first direction thereby causing the worm gear 228 to turn, which turns the pinion gear 230, which causes the gear rack 232 to move in the first direction. The gear rack contacts the lid latch 222 and causes the lid latch 222 to rotate about pivot 238 counterclockwise, thereby releasing the lid hook 206. In certain embodiments, a spring (not visible in FIG. 3) coupled between the lid 204 and the body 202 then causes the released lid 204 to rotate upward, granting access to the contents of the receptacle 200.

An example of releasing the receptacle 200 from the retention tray 250 begins with the processor 260 receiving a receptacle-release signal through the electrical contacts 262A. The processor sends a command to the motor 226 to turn in the second direction thereby causing the worm gear 228 to turn, which turns the pinion gear 230, which causes the gear rack 232 to move in the second direction. The gear rack contacts the tray latch 234 and causes the tray latch 234 to rotate about pivot 240 counterclockwise, thereby releasing the tray hook 252. In certain embodiments, a receptacle release spring 254 coupled between the tray 250 and the body 202 then causes the receptacle 200 to move upward, allowing a user to grasp the receptacle 200 and remove the receptacle 200 from the retention tray 250.

In certain embodiments, the actuator 242 also comprises a worm gear 228 coupled to the shaft 227 and a pinion gear 230 rotatably coupled to the body 202. In certain embodiments, the pinion gear 230 is configured to rotate about a pivot 231 that is fixed to the body 202. In certain embodiments, the pinion gear 230 is coupled between the worm gear 228 and the gear rack 232 as shown in FIG. 3.

FIG. 4 is a block diagram of an exemplary electronic portion of the receptacle 200 according to certain aspects of the present disclosure. In certain embodiments, the receptacle 200 comprises a processor 260 that is communicatively coupled to the motor 242 and to a communication interface 262. In certain embodiments, the processor 260 is coupled to a memory 264. In certain embodiments, the memory 264 is integral with the processor 260 in a single device. In certain embodiments, the processor 260 is configured to exchange signals with an external device, for example a processor of an ADM such as shown in FIG. 5, through communication interface 262. In certain embodiments, the communication interface 262 comprises one or more electrical contacts 262A on an external surface of the body 202, the contacts 262A configured to removably couple to an electrical connector 256, shown in FIG. 3, on the retention tray 250. In certain embodiments, the communication interface 262 comprises a wireless communication device, for example a Bluetooth®-compatible transceiver. In certain embodiments, the processor 260 is configured to receive information from an external device and store this information in the memory 264, the information comprising one or more of an identifier associated with the receptacle 200, an identifier associated with an item disposed within the receptacle 200, a name and dose of a medication disposed within the receptacle 200, and an expiration date of a medication disposed within the receptacle 200.

FIG. 5 depicts an exemplary ADM 300 according to certain aspects of the present disclosure. The ADM 300 comprises a user interface that includes a control top 302 that includes a display 304 and a keyboard 306 and a processor (not visible in FIG. 5). The ADM 300 also includes a cabinet 310 having a plurality of drawers, for example a drawer system 312 configured to receive one or more of the receptacles 200 in one or more docking stations 258, shown in FIG. 7B. In certain embodiments, the cabinet 310 also includes a half-height open drawer 314, a 16-drawer step-drawer assembly 316, a 6-drawer step-drawer assembly 318, and a full-height open drawer 312. In certain embodiments, the ADM 300 is configured to contain medications and supplies for use in a hospital or healthcare environment.

Figure 6:
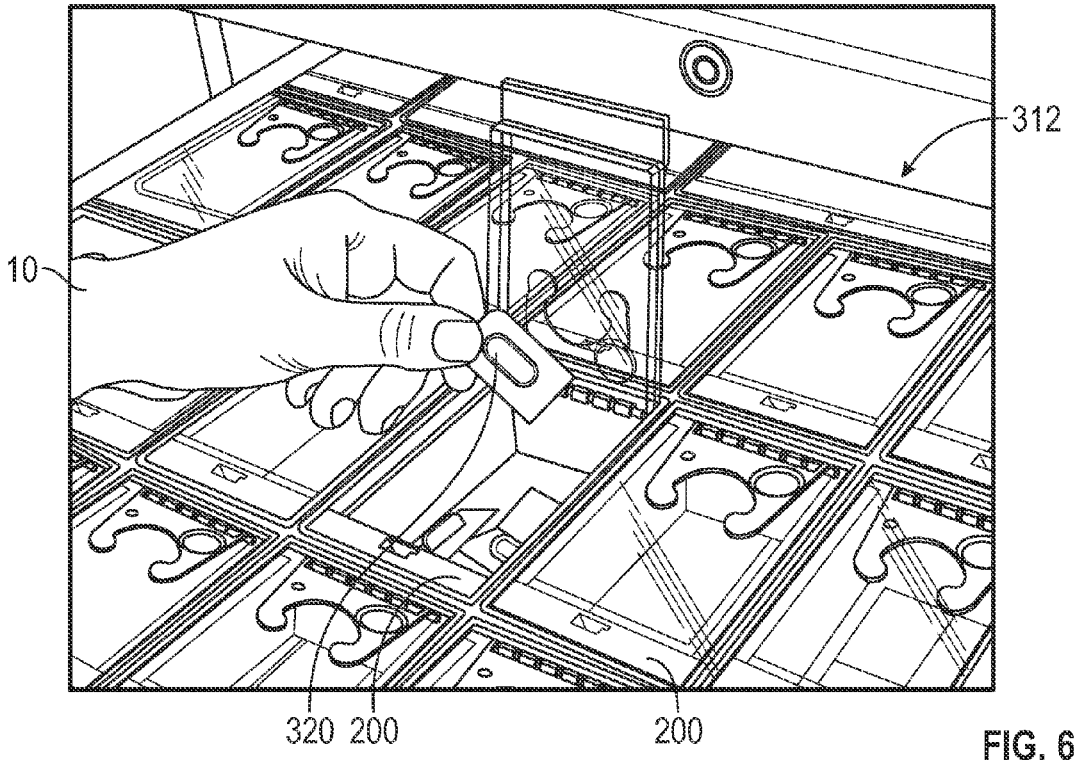
FIG. 6 depicts a user removing a medication from a receptacle disposed in a drawer assembly according to certain aspects of the present disclosure.

FIG. 6 depicts a user 10 removing a medication 320 from a receptacle 200 disposed in a drawer assembly 312 according to certain aspects of the present disclosure. It can be seen that only the contents of the one receptacle 200 are available to the user 10, while the remaining receptacle 200 remain closed. In certain embodiments, an ADM 300 with a drawer assembly 312 is located in hospital. The drawer assembly 312 contains a plurality of receptacles 200, each containing a different medication 320. A user 10 may access one of medications 320 by indicating through the user interface of the ADM 300 which medication 320 the user 10 wished to remove. The ADM 200 will allow the drawer 312 to be opened, then the processor of the ADM 200 will send a lid-release signal to the receptacle 200 that contains the desired medication 320, which causes the lid 204 of that receptacle 200 to be released and open upward, thereby allowing the user 10 access to the doses of the medication 320 that are contained in the receptacle 200. After removing the medication 320, the user 10 will close the lid 204, which is retained in the closed position by the lid latch 222, and then close the drawer assembly 312.

Another example use of the disclosed receptacle 200 is the removal of a receptacle 200 from the ADM 300 by a pharmacy technician or other authorized person. The technician indicates through the user interface which receptacle 200 is to be removed. The ADM 200 will allow the drawer 312 to be opened, then the processor of the ADM 200 will send a receptacle-release signal to the receptacle 200, which causes the tray latch 235 to release the tray hook 252, thereby allowing the receptacle 200 to be pushed upward by the receptacle release spring 254. The upward motion of the receptacle 200 not only provides a visual indication of which receptacle 200 to be removed, it provides access to the side surfaces of the body 202 such that the technician can easily grasp the receptacle 200 and remove it from the docking location 258.

Figure 7A:
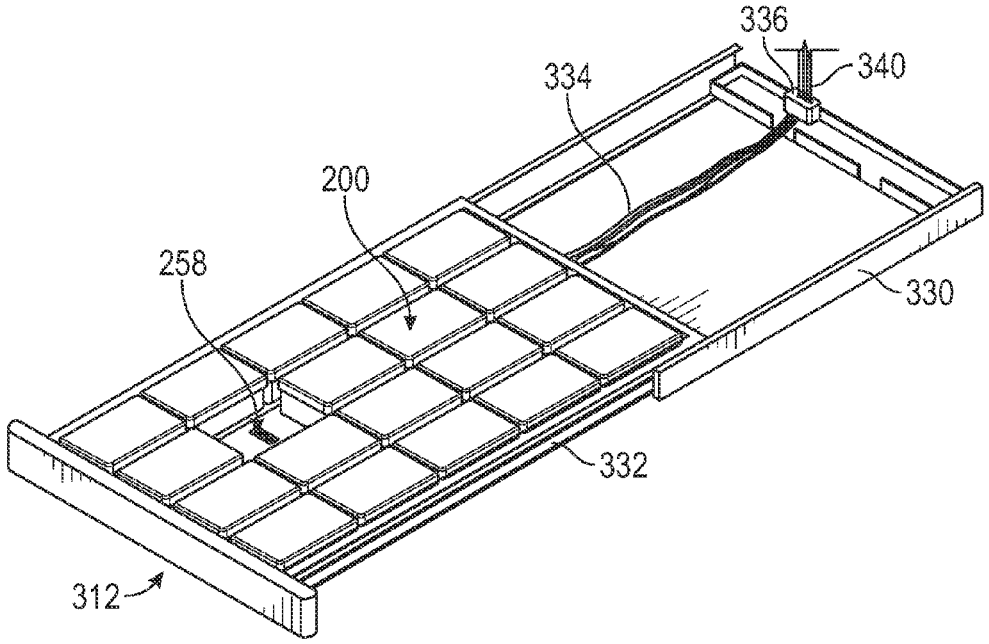
FIG. 7A depicts an exemplary drawer assembly according to certain aspects of the present disclosure.

FIG. 7A depicts an exemplary drawer assembly 312 according to certain aspects of the present disclosure. The drawer assembly 312 includes multiple docking locations 258. In certain embodiments, the receptacle 200 is configured to occupy a single docking location 258. In certain embodiments, the receptacle 200 is larger and configured to occupy a plurality of adjacent docking locations 258. The drawer assembly 312 also includes a pair of support slides having a moving slide 332 and fixed slide 330. The drawer assembly 312 also includes a cable 334 that connects the electrical connector 256 (not visible in FIG. 7A) to a drawer connector 336 at the rear of the drawer assembly 312. The drawer connector 336 is configured to connect to an ADM cable 340 that communicates with a processor located in the control top 302 of the ADM 300.

Figure 7B:
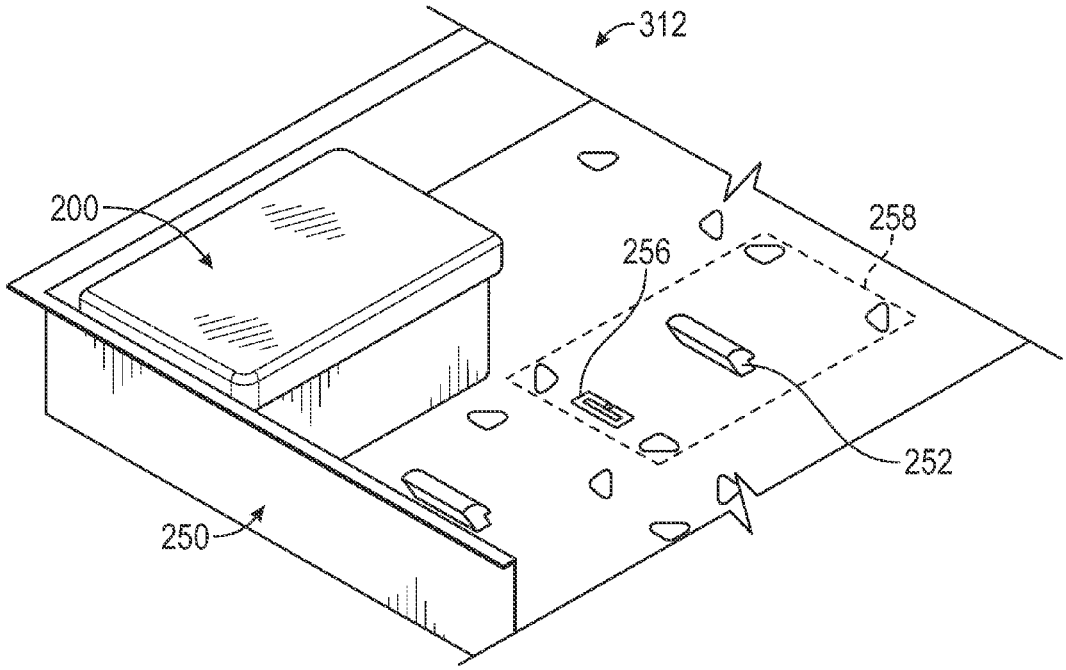
FIG. 7B depicts a portion of the drawer assembly of FIG. 7A according to certain aspects of the present disclosure.

FIG. 7B depicts a portion of the drawer assembly 312 of FIG. 6A according to certain aspects of the present disclosure. In certain embodiments, the retention tray 250 has sidewalls and a bottom that line a metal drawer structure (not visible in FIG. 7A). The broken-line box indicates a docking location 258, within which are located a tray hook 252 and an electrical connector 256. A receptacle 200 is shown disposed in a docking location 258 in the corner of the retention tray 250.

The disclosed examples of a receptacle with a dual-function actuator illustrate how a single actuator can be configured to selectively release either of two retention hooks. By actuating the actuator in a first direction, a first hook is released while the second hook is retained in the latched position. Similarly, by actuating the actuator in a second direction, opposite to the first direction, the second hook is released while the first hook is retained in the latched position.

The use of the actuator of the receptacle to retain and release the receptacle from the tray, compared to the provision of the individual actuators for each docking location on the tray as disclosed by of U.S. Pat. No. 6,116,461, eliminates all of the actuators and related mechanisms and electronics from the tray. This significantly reduces the cost and complexity of the tray, and also removes these vulnerable mechanisms as points of possible failure.

It is understood that the specific order or hierarchy of steps or blocks in the processes disclosed is an illustration of exemplary approaches. Based upon design preferences, it is understood that the specific order or hierarchy of steps or blocks in the processes may be rearranged. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims.

Reference to an element in the singular is not intended to mean "one and only one" unless specifically so stated, but rather "one or more." Use of the articles "a" and "an" is to be interpreted as equivalent to the phrase "at least one." Unless specifically stated otherwise, the term "some" refers to one or more.

Pronouns in the masculine (e.g., his) include the feminine and neuter gender (e.g., her and its) and vice versa. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "operation for."

Although embodiments of the present disclosure have been described and illustrated in detail, it is to be clearly understood that the same is by way of illustration and example only and is not to be taken by way of limitation, the scope of the present invention being limited only by the terms of the appended claims.

What is claimed is:

1. A receptacle adapted for removable securement on a retention tray, the receptacle comprising:

a body;

a lid movably coupled to the body, the lid having a closed position, the lid comprising a lid hook; and a latching apparatus coupled to the body, the latching apparatus comprising:

a lid latch having a latched position, the lid latch configured to engage the lid hook when the lid is in the closed position and the lid latch is in the latched position, the lid latch configured to rotate about a first pivot fixed to the body to move away from the latched position;

a first spring configured to urge the lid latch toward the latched position;

a tray latch having a latched position, the tray latch configured to engage a tray hook that is coupled to the retention tray when the receptacle is placed on the retention tray, the tray latch configured to rotate about a second pivot fixed to the body to move away from the latched position;

a second spring configured to urge the tray latch toward the latched position; and an actuator configured to selectably move in a first direction thereby urging the lid latch and the first spring to move away from the latched position, the actuator further configured to selectably move in a second direction that is opposite the first direction thereby urging the tray latch and the second spring to move away from the latched position, wherein when the actuator moves in the first direction, the actuator urges the lid latch to move without moving the tray latch, and when the actuator moves in the second direction, the actuator urges the tray latch to move without moving the lid latch.

2. The receptacle of claim 1, wherein:

the body comprises a compartment having a top and a bottom;

the latching apparatus is disposed within the compartment;

the lid hook protrudes into the compartment through the top of the compartment when the lid is in the closed position; and the tray hook protrudes into the compartment through the bottom of the compartment when the receptacle is disposed on the retention tray.

3. The receptacle of claim 1, wherein the actuator comprises:

a gear rack having an axis and movably coupled to the body, the gear rack configured to cause the lid latch to rotate away from the latched position when moved in the first direction and to cause the tray latch to rotate away from the latched position when moved in the second direction; and a motor comprising a housing that is coupled to the body and a rotatable shaft configured to selectably rotate in the first direction or the second direction, the shaft coupled to the gear rack such that rotation of the shaft in the first direction causes the gear rack to move in the first direction and rotation of the shaft in the second direction causes the gear rack to move in the second direction.

4. The receptacle of claim 3, wherein the actuator further comprises:

a worm gear coupled to the shaft; and a pinion gear rotatably coupled to the body, the pinion gear coupled between the worm gear and the gear rack.

5. The receptacle of claim 3, wherein the receptacle further comprises a processor coupled to the motor, the processor configured to receive signals from an external device, the processor further configured to cause the motor to rotate in the first direction upon receipt of a lid-release signal and to cause the motor to rotate in the second direction upon receipt of receptacle-release signal.

6. The receptacle of claim 5, wherein the receptacle further comprises a communication interface coupled to the processor such that the processor may exchange signals with the external source through the communication interface.

7. The receptacle of claim 6, wherein the communication interface comprises one or more electrical contacts on an external surface of the body, the contacts configured to removably couple to an electrical connector on the retention tray.

8. The receptacle of claim 6, wherein the communication interface comprises a wireless communication device.

9. The receptacle of claim 1, wherein the receptacle further comprises a lid spring coupled between the lid and the body, the lid spring configured to urge the lid to move away from the closed position.

10. A latch apparatus for securing and selectably releasing either of a first hook and a second hook, the apparatus comprising:

a substrate;

a first latch rotatably coupled to the substrate, the first latch having a latched position, the first latch configured to engage the first hook when the first latch is in the latched position, the first latch configured to rotate about a first pivot fixed to substrate to move away from the latched position;

a first spring configured to urge the first latch toward the latched position;

a second latch rotatably coupled to the substrate, the second latch having a latched position, the second latch configured to engage the second hook when the second latch is in the latched position, the second latch configured to rotate about a second pivot fixed to the substrate to move away from the latched position;

a second spring configured to urge the second latch toward the latched position; and an actuator configured to selectably move in a first direction thereby urging the first latch and the first spring to move away from the latched position, the actuator further configured to selectably move in a second direction that is opposite the first direction thereby urging the second latch and the second spring to move away from the latched position, wherein when the actuator moves in the first direction, the actuator urges the first latch to move without moving the second latch, and when the actuator moves in the second direction, the actuator urges the second latch to move without moving the first lid latch.

11. The latch apparatus of claim 10, wherein the actuator comprises:

a gear rack having an axis and movably coupled to the substrate, the gear rack configured to cause the first latch to rotate away from the latched position when moved in the first direction and to cause the second latch to rotate away from the latched position when moved in the second direction; and a motor comprising a housing that is coupled to the substrate and a rotatable shaft configured to selectably rotate in the first direction or the second direction, the shaft coupled to the gear rack such that rotation of the shaft in the first direction causes the gear rack to move in the first direction and rotation of the shaft in the second direction causes the gear rack to move in the second direction.

12. A drawer system comprising:

a retention tray comprising a plurality of docking locations, each docking location comprising a tray hook coupled to the retention tray; and at least one receptacle comprising;

a body;

a lid movably coupled to the body, the lid having a closed position, the lid comprising a lid hook; and a latching apparatus coupled to the body, the latching apparatus comprising:

a lid latch having a latched position, the lid latch configured to engage the lid hook when the lid is in the closed position and the lid latch is in the latched position, the lid latch configured to rotate about a first pivot fixed to the body to move away from the latched position;

a first spring configured to urge the lid latch toward the latched position;

a tray latch having a latched position, the tray latch configured to engage the tray hook when the receptacle is placed on one of the docking locations of the retention tray, the tray latch configured to rotate about a second pivot fixed to the body to move away from the latched position;

a second spring configured to urge the tray latch toward the latched position; and an actuator configured to selectably move in a first direction thereby urging the lid latch and the first spring to move away from the latched position, the actuator further configured to selectably move in a second direction that is opposite the first direction thereby urging the tray latch and the second spring to move away from the latched position, wherein when the actuator moves in the first direction, the actuator urges the lid latch to move without moving the tray latch, and when the actuator moves in the second direction, the actuator urges the tray latch to move without moving the lid latch, and wherein the retention tray is configured to receive a plurality of receptacles in the plurality docking stations.

13. The drawer system of claim 12, wherein the receptacle further comprises a processor coupled to a motor of the actuator, the processor configured to receive signals from an external source, the processor further configured to cause the motor to rotate in the first direction upon receipt of a lid-release signal and to cause the motor to rotate in the second direction upon receipt of receptacle-release signal.

14. The drawer system of claim 12, wherein:

the body comprises a compartment having a top and a bottom;

the latching apparatus is disposed within the compartment;

the lid hook protrudes into the compartment through the top of the compartment when the lid is in the closed position; and the tray hook protrudes into the compartment through the bottom of the compartment when the receptacle is disposed on the retention tray.

15. The drawer system of claim 12, wherein:

the actuator comprises:

a gear rack having an axis and movably coupled to the body, the gear rack configured to cause the lid latch to rotate away from the latched position when moved in the first direction and to cause the tray latch to rotate away from the latched position when moved in the second direction; and a motor comprising a housing that is coupled to the body and a rotatable shaft configured to selectably rotate in the first direction or the second direction, the shaft coupled to the gear rack such that rotation of the shaft in the first direction causes the gear rack to move in the first direction and rotation of the shaft in the second direction causes the gear rack to move in the second direction.

16. An automated dispensing machine (ADM) comprising:

at least one drawer system comprising:

a retention tray comprising a plurality of docking locations, each docking location comprising a tray hook coupled to the retention tray; and at least one receptacle comprising;

a body;

a lid movably coupled to the body, the lid having a closed position, the lid comprising a lid hook; and a latching apparatus coupled to the body, the latching apparatus comprising:

a lid latch having a latched position, the lid latch configured to engage the lid hook when the lid is in the closed position and the lid latch is in the latched position, the lid latch configured to rotate about a first pivot fixed to the body to move away from the latched position;

a first spring configured to urge the lid latch toward the latched position;

a tray latch having a latched position, the tray latch configured to engage the tray hook when the receptacle is placed on one of the docking locations of the retention tray, the tray latch configured to rotate about a second pivot fixed to the body to move away from the latched position;

a second spring configured to urge the tray latch toward the latched position; and an actuator configured to selectably move in a first direction thereby urging the lid latch and the first spring to move away from the latched position, the actuator further configured to selectably move in a second direction that is opposite the first direction thereby urging the tray latch and the second spring to move away from the latched position, wherein when the actuator moves in the first direction, the actuator urges the lid latch to move without moving the tray latch, and when the actuator moves in the second direction, the actuator urges the tray latch to move without moving the lid latch.

17. The ADM of claim 16, wherein the receptacle further comprises a processor coupled to a motor of the actuator, the processor configured to receive signals from an external source, the processor further configured to cause the motor to rotate in the first direction upon receipt of a lid-release signal and to cause the motor to rotate in the second direction upon receipt of receptacle-release signal.

18. The ADM of claim 16, wherein:

the body comprises a compartment having a top and a bottom;

the latching apparatus is disposed within the compartment;

the lid hook protrudes into the compartment through the top of the compartment when the lid is in the closed position; and the tray hook protrudes into the compartment through the bottom of the compartment when the receptacle is disposed on the retention tray.

19. The ADM of claim 16, wherein:

the actuator comprises:

a gear rack having an axis and movably coupled to the body, the gear rack configured to cause the lid latch to rotate away from the latched position when moved in the first direction and to cause the tray latch to rotate away from the latched position when moved in the second direction; and a motor comprising a housing that is coupled to the body and a rotatable shaft configured to selectably rotate in the first direction or the second direction, the shaft coupled to the gear rack such that rotation of the shaft in the first direction causes the gear rack to move in the first direction and rotation of the shaft in the second direction causes the gear rack to move in the second direction.

* * * * *